US007751752B2

(12) United States Patent
Komatsu

(10) Patent No.: US 7,751,752 B2
(45) Date of Patent: Jul. 6, 2010

(54) IMAGE FORMING APPARATUS

(75) Inventor: Isao Komatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 11/936,020

(22) Filed: Nov. 6, 2007

(65) Prior Publication Data

US 2008/0118272 A1 May 22, 2008

(30) Foreign Application Priority Data

Nov. 16, 2006 (JP) ..... 2006-310379

(51) Int. Cl.
*G03G 15/24* (2006.01)
*G03G 15/30* (2006.01)

(52) U.S. Cl. ..... 399/148; 399/149; 399/150

(58) Field of Classification Search ..... 399/148–150
See application file for complete search history.

(56) References Cited

U.S. PATENT DOCUMENTS 6,006,055 A 12/1999 Furuya
6,480,695 B2 * 11/2002 Endo et al. ..... 399/349
7,469,116 B2 * 12/2008 Kitajima ..... 399/149

FOREIGN PATENT DOCUMENTS

JP 10-312098 A 11/1998
JP 11-072995 A 3/1999

* cited by examiner

*Primary Examiner*—David M Gray
*Assistant Examiner*—Erika Villaluna
(74) *Attorney, Agent, or Firm*—Canon U.S.A., Inc. I.P. Division

(57) ABSTRACT

An image forming apparatus includes a rotatable brush in contact with an image bearing member at a position downstream of transfer means and upstream of charging means in a rotational direction of the image bearing member. The rotational brush is configured to supply electrical charge to residual toner that remains on the image bearing member. The image forming apparatus executes a mode for removing toner particles attached to the brush by setting a peripheral speed of the brush to be lower than that of the image bearing member during an image forming time period and setting the peripheral speed of the brush to be higher than that of the image bearing member during at least part of a non-image forming time period.

4 Claims, 6 Drawing Sheets

IMAGE FORMING APPARATUS

BACKGROUND OF THE INVENTION

1. Field of the Invention

The present invention relates to an image forming apparatus for transferring a toner image formed on an image bearing member onto a recording material and, more particularly, to an image forming apparatus including a rotatable brush that applies an electrical charge to residual toner remaining on the image bearing member.

2. Description of the Related Art

Recently, multi-function peripherals that include output terminal functions, such as copier, printer, and facsimile functions, in one body have been widely used. For these output terminals, electrophotographic image forming apparatuses have been widely used. For such electrophotographic image forming apparatuses, with an increase in the processing speed, the useful life thereof is expected to increase. In addition, for ecological reasons, waste generation needs to be reduced. That is, the number of disposables needs to be reduced and the life expectancy of disposables needs to be increased. Furthermore, the reliability of the disposables needs to be increased.

Accordingly, in order to sufficiently remove residual toner and increase the wear life of a photosensitive member, systems known as "cleaner-less systems" is employed. Cleaner-less systems include no cleaning units. After a transfer process is completed, a developing unit removes and recovers residual toner deposited on a photosensitive member using a "simultaneous development and recovery" technique. Thus, the toner is reused. In the simultaneous development and recovery technique, residual toner deposited on a photosensitive member is recovered in the subsequent development process. That is, in the subsequent development process, residual toner remaining in areas of the surface of the photosensitive member where an image should not be developed with toner (i.e., non-image portions) is recovered to a developing unit using a fog-removing voltage difference Vback, which is a difference between a direct current voltage applied to the developing unit and the surface voltage of the photosensitive member.

By using the simultaneous development and recovery technique, the need for a member that slides on a photosensitive member, such as a counter blade, can be eliminated. Thus, the wear life of the photosensitive member can be significantly increased. In addition, the cost can be reduced. In such a cleaner-less system, an auxiliary charging brush is disposed downstream of the primary transfer unit in order to control the polarity of the charge of the residual toner. The auxiliary charging brush is made from a conductive fiber. The auxiliary charging brush is disposed between the primary transfer unit and a charging unit. A voltage having a polarity the same as the charging polarity of the toner is applied to the auxiliary charging brush. Alternatively, a structure is widely used in which a brush including a conductive fiber to which a voltage having a polarity opposite to the charging polarity of the toner is applied is disposed upstream of a brush to which a voltage having a polarity the same as the charging polarity of the toner is applied and downstream of the primary developing unit in the rotational direction of the photosensitive member.

However, in the cleaner-less systems, a problem of an auxiliary charging brush filled with toner may occur. If the auxiliary charging brush is saturated with toner particles, an amount of electrical current flowing from the brush to a photosensitive drum decreases. For example, when paper jam occurs or an image requiring a large amount of toner is formed, a large amount of residual toner remains on the photosensitive member. In such a case, the brush is easily saturated with toner particles, and therefore, the amount of electrical current flowing into the photosensitive member significantly decreases. In particular, if the amount of electrical current flowing from the downstream brush decreases, it is difficult to control the polarity of the charge of the toner. Consequently, a large amount of the toner having charge of an opposite polarity may remain on the photosensitive drum. Furthermore, a charger roller may not be uniformly charged. Therefore, a defective image, such as a foggy image or a grainy foggy image, may be generated.

To prevent this problem, a fur brush that is not easily saturated with toner particles may be used. However, even when a fur brush is used, the fur brush may become saturated with toner due to environmental conditions or the deterioration thereof. In such a case, the toner particles need to be removed from the fur brush. To remove toner particles, a bias having a polarity opposite to that usually used for forming an image may be applied to the brush (refer to, for example, Japanese Patent Laid-Open No. 11-72995).

However, in the method for removing toner particles from the brush by applying a bias as described in Japanese Patent Laid-Open No. 11-72995, the toner particles may not be completely removed as the condition deteriorates.

This is because toner particles staying on the top end of the brush move towards the anchor end of the brush as the brush is used for a long term. The toner particles deposited on the top end of the brush can be removed by applying the bias. However, to remove the toner particles deposited on the anchor end of the brush, application of a high bias is needed. The withstand voltage of the brush is decreased as the brush is used for the long time. Thus, as the brush is used for the long time, it may be more difficult to remove the toner particles deposited in the brush.

Additionally, Japanese Patent Laid-Open No. 10-312098 describes a technique for preventing a brush from being saturated with paper dust. In this technique, paper dust is removed from the brush by supporting the brush in a rotatable manner and causing a drum to be rotated by the rotation of the brush. Alternatively, paper dust is removed from the brush by stopping the rotation of the brush during formation of an image and causing the brush to be rotated by the rotation of a drum when no images are formed. However, since the brush is rotated simply by the rotation of the drum, almost all toner particles in the brush cannot be removed. Thus, as the brush is used for a long term, the brush may be saturated with toner particles.

In addition, since this cleaner system does not include a cleaning unit for removing toner deposited on the surface of the drum, the deposited toner tends to cause a phenomenon known as filming in which the deposited toner becomes fused to the surface of the drum. If this phenomenon happens, a latent image is not completely formed on the drum. Thus, a defective image is produced. In particular, when the rotation speed of the fur brush serving as a charge supplying unit is high, filming may easily occur.

SUMMARY OF THE INVENTION

An embodiment of the present invention provides an image forming apparatus capable of preventing a brush in a charge supplying unit from being saturated with toner particles using a simple technique and preventing toner from being fused on a drum.

According to an embodiment of the present invention, an image forming apparatus includes an image bearing member configured to bear a toner image, charging means configured to charge a surface of the image bearing member, latent image-forming means configured to form an electrostatic latent image on the image bearing member charged by the charging means, developing means configured to develop the electrostatic latent image with toner and recover residual toner remaining on the image bearing member, transfer means configured to transfer a toner image developed on the image bearing member onto a recording material, a rotatable brush being in contact with the image bearing member at a position downstream of the transfer means and upstream of the charging means in a rotational direction of the image bearing member, where the rotatable brush is configured to supply electrical charge to the residual toner that is not transferred by the transfer means and remains on the image bearing member, and executing means. The executing means is configured to execute for setting a peripheral speed of the brush to be lower than that of the image bearing member during an image forming period of time and setting the peripheral speed of the brush to be higher than that of the image bearing member during at least part of a non-image forming period of time.

According to an embodiment of the present invention, a cleaner system can prevent toner particles from being deposited on a drum by preventing toner particles from being embedded in an auxiliary charging brush using a simple technique.

Further features of the present invention will become apparent from the following description of exemplary embodiments with reference to the attached drawings.

DESCRIPTION OF THE EMBODIMENTS

Embodiments of the present invention are described in more detail below with reference to the accompanying drawings.

(1) Image Forming Apparatus

Figure 3:
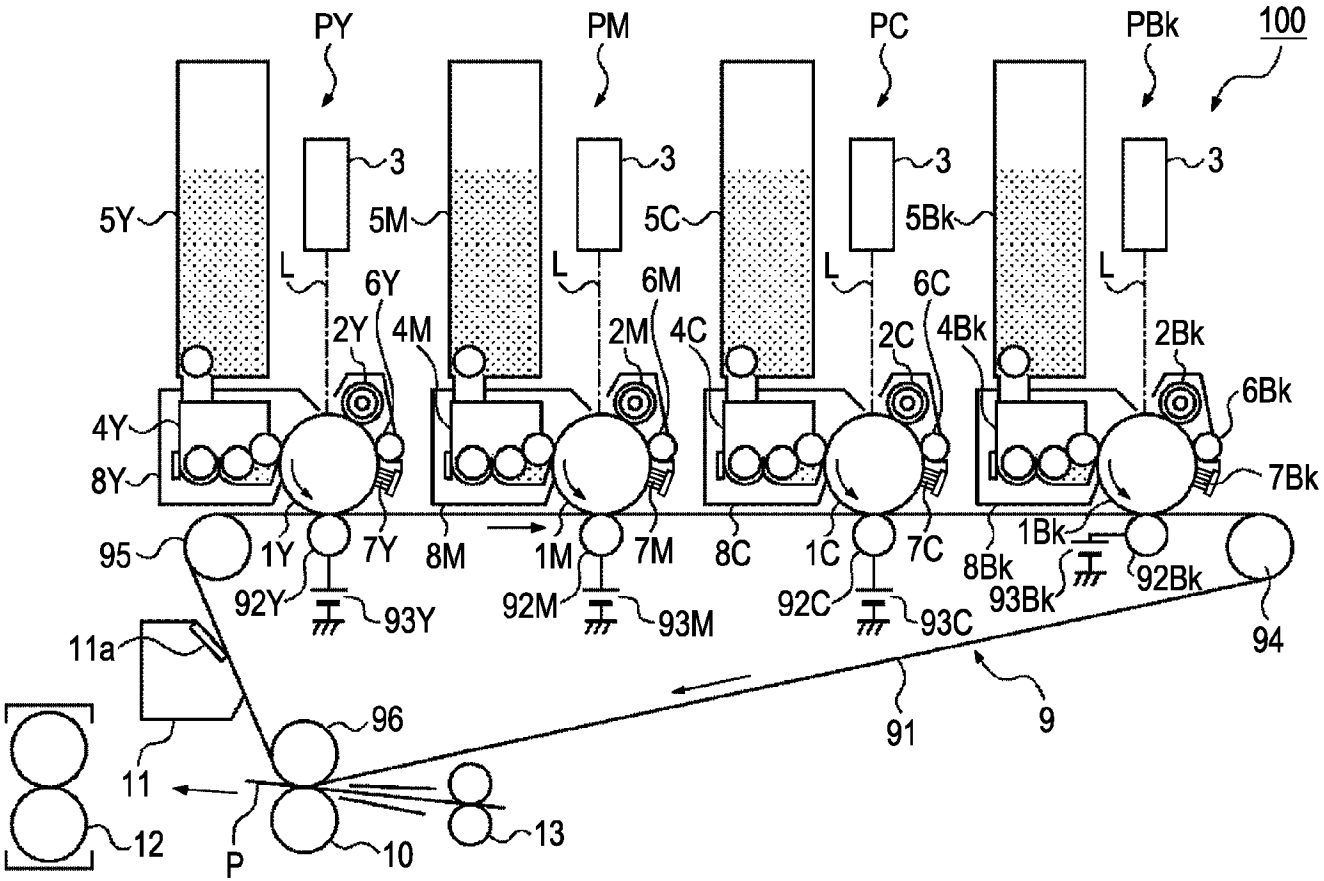
FIG. 3 is a schematic illustration of a four-drum type color electrophotographic printer according to an embodiment of the present invention.

FIG. 3 is a schematic illustration of an image forming apparatus according to an embodiment of the present invention. According to the present embodiment, an image forming apparatus 100 is a color laser printer using a toner transferring electrophotographic process, a contact charging method, and a reversal developing method. In an embodiment, the maximum paper size the image forming apparatus 100 can print on is A3. In accordance with image information from an external host apparatus connected to the image forming apparatus (the body of the image forming apparatus), the image forming apparatus can form a full-color image on a transfer medium, such as a paper sheet, an OHP sheet, or fabric, and output the transfer medium. The image forming apparatus 100 is a four-drum-tandem type (inline) color printer. That is, the image forming apparatus 100 includes four process cartridges 8. Each of the process cartridges 8 sequentially transfers a toner image on top of the image previously formed on an intermediate transfer member 91. Thereafter, the multiple overlay images are transferred onto a transfer medium P simultaneously so that a full-color print image can be obtained. The yellow, magenta, cyan, and black process cartridges 8 are disposed in this order in a line along the moving direction of the intermediate transfer member 91.

According to the present embodiment, image-forming units PY, PM, PC, and PBk are provided for forming images of colors yellow (Y), magenta (M), cyan (C), and black (K), respectively. The image-forming units PY, PM, PC, and PBk have a similar structure except for a color of toner used. Accordingly, hereinafter, for the image-forming units, suffixes "Y", "M", "C", and "B" of the reference numerals for representing the colors are removed in the case where the distinction is not needed, and the common features are described. For example, in a description of an operation for forming a four-full-color image, an image signal for each color is generated in accordance with a signal received from an external host apparatus connected to the image forming apparatus 100. Process cartridges 8Y, 8M, 8C, and 8K of the respective image-forming units PY, PM, PC, and PBk form toner images of the four colors in accordance with the image signals of the four colors.

In each of the process cartridges 8Y, 8M, 8C, and 8K, an electrophotographic sensitive member (a photosensitive drum) 1 is charged by a charging unit 2. The photosensitive drum 1 has a photosensitive layer consisting of an organic material on a conductive support member so as to serve as an image bearing member. The charge are uniformly applied to the surface of the photosensitive drum 1. By performing scanning exposure for the surface using an exposure unit 3, an electrostatic latent image is formed on the photosensitive drum 1. By supplying toner serving as a developer material to the electrostatic latent image using a developing unit, a toner image is formed. The toner image of each color formed on the corresponding photosensitive drum 1 is sequentially transferred on top of a toner image previously formed on an intermediate transfer belt 91 serving as a moving intermediate transfer member (a second image bearing member). Thereafter, the full-color toner image formed on the intermediate transfer belt 91 is transferred onto the transfer medium P conveyed into a secondary transfer unit at one time. In the secondary transfer unit, a secondary transfer roller 10 serving as a secondary transfer unit faces the intermediate transfer belt 91. Subsequently, the transfer medium P is conveyed to a fixing unit 12. The toner image is fixed to the transfer medium P by the fixing unit 12. The transfer medium P is then output to outside the image forming apparatus.

Figure 4:
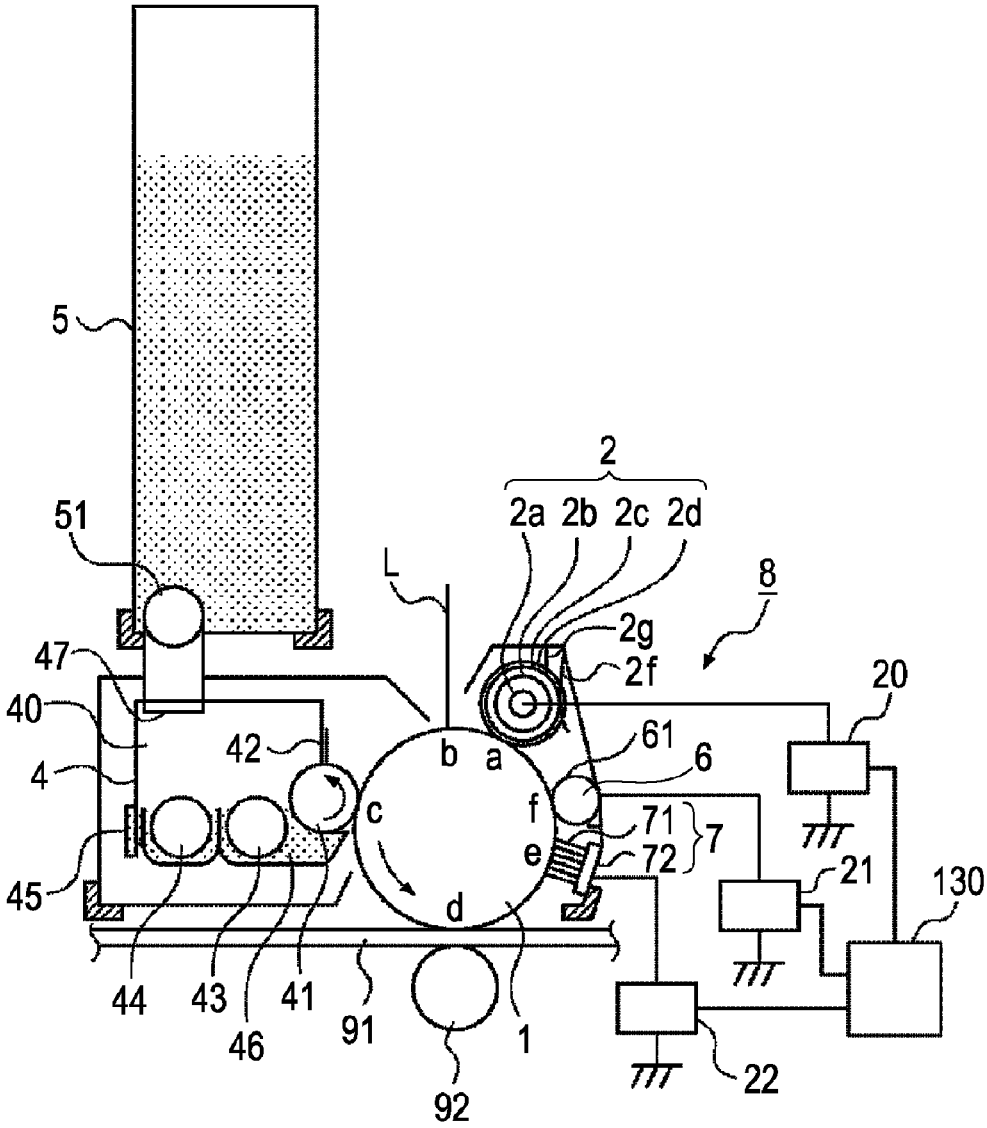
FIG. 4 is a schematic cross-sectional view of a photosensitive drum and parts around the photosensitive drum in an image-forming unit including a cleaning-less system according to the embodiment.

Each of the components of the image forming apparatus 100 is described next in more detail with reference to FIG. 4. The image forming apparatus 100 includes the electrophotographic photosensitive member (the photosensitive drum) 1 of a rotatable drum type as an image bearing member. According to the present embodiment, photosensitive drums 1Y, 1M, 1C, and 1K are organic photo conductor (OPC) drums. The outer diameter of each of the photosensitive drums 1Y, 1M, 1C, and 1K is 30 mm. When an image is formed, each of the photosensitive drums 1Y, 1M, 1C, and 1K is driven to rotate about a center support shaft thereof at a process speed (peripheral speed) of 130 mm/sec in a counter-clockwise direction indicated by an arrow in FIG. 4.

(a) Charging Unit

According to the present embodiment, each of the process cartridges 8Y, 8M, 8C, and 8K of the image-forming units PY, PM, PC, and PBk includes a charge roller 2 serving as the charging unit 2. The charge roller 2 functions as a contact charger. By applying a predetermined voltage to the charge roller 2, the photosensitive drum 1 is uniformly negatively charged. The length of the charge roller 2 is 320 mm. The charge roller 2 has three layers: a lower layer 2*b*, an intermediate layer 2*c*, and a surface layer 2*d* layered in this order around a core metal (a supporting member) 2*a*. The lower layer 2*b* is a foamed sponge layer used for reducing charge noise. The intermediate layer 2*c* is a resistive layer for obtaining uniform resistance over the entire charge roller 2. The surface layer 2*d* is a protective layer that prevents leakage of charge even when a defect, such as a pin hole, is present on the photosensitive drum 1.

According to the present embodiment, the core metal 2*a* consists of a stainless steel rod having a diameter of 6 mm. The surface layer 2*d* is made of fluorine resin in which carbon is dispersed. The external diameter of the charge roller 2 is 14 mm. The roller resistance ranges from $10^4\Omega$ to $10^7\Omega$. Either end of the core metal 2*a* of the charge roller 2 is rotatably supported by bearing units. The charge roller 2 is pressed against the photosensitive drum 1 by a pressure spring so as to be in contact with the surface of the photosensitive drum 1 with a predetermined pressure force. In addition, the charge roller 2 is rotatingly driven by the rotation of the photosensitive drum 1. A power supply 20 serving as a voltage applying unit applies a predetermined vibrating voltage (a charge bias voltage Vdc+Vac: a voltage obtained by superimposing an alternate current voltage having a predetermined frequency over a direct current voltage) to the charge roller 2 via the core metal 2*a*. Thus, the peripheral surface of the rotating photosensitive drum 1 is charged to a predetermined electrical potential. A contact portion between the charge roller 2 and the photosensitive drum 1 is a charge portion "a". According to the present embodiment, a charge bias voltage applied to the charge roller 2 is a vibrating voltage obtained by superimposing a sine wave shaped alternate current voltage having a frequency of 1270 Hz and a peak-to-peak voltage of 1400 V over a direct current voltage of −500 V. The peripheral surface of the photosensitive drum 1 is uniformly contact-charged to −500 V (dark portion potential Vd).

According to the present embodiment, a charge roller cleaning member 2*f* is formed from a flexible cleaning film. The charge roller cleaning member 2*f* is disposed parallel to the lengthwise direction of the charge roller 2. In addition, one end of the charge roller cleaning member 2*f* is supported by a supporting member 2*g* that reciprocates by a predetermined distance in the lengthwise direction of the charge roller 2. The surface of the charge roller cleaning member 2*f* in the vicinity of the other free end thereof and the charge roller 2 form a contact nip. The supporting member 2*g* is driven by a driving motor of the image forming apparatus 100 via a gear train so as to reciprocate by the predetermined distance in the lengthwise direction of the charge roller 2. Thus, the charge roller cleaning member 2*f* slides along the surface layer 2*d* of the charge roller 2. In this way, contamination (e.g., toner particles and fillers) deposited on the surface layer 2*d* of the charge roller 2 is removed. After the photosensitive drum 1 is uniformly charged to predetermined polarity and potential by the charge roller 2, the photosensitive drum 1 is exposed to image exposure light L by an image exposure unit. Thus, an electrostatic latent image of a color component corresponding to each of the image-forming units PY, PM, PC, and PBk is formed. The image exposure unit includes a color-separation/image-formation exposure optical system for a color document image and a laser-beam scanning exposure system that outputs a laser beam modulated in accordance with a time-series electrical digital pixel signal of image information.

(b) Latent Image Forming Unit

According to the present embodiment, a laser beam scanner 3 including a semiconductor laser is used for a latent image-forming unit (an exposure unit). The laser beam scanner 3 outputs a laser beam modulated in accordance with an image signal sent from a host apparatus, such as an image scanning apparatus (not shown), to the image forming apparatus 100. In this way, the laser beam scanner 3 performs scanning exposure (image exposure) on the uniformly charged surface of the rotating photosensitive drum 1 using the laser beam. In the laser scanning exposure operation, the electric potential of a portion of the surface of the photosensitive drum 1 irradiated with the image exposure light L decreases. Accordingly, an electrostatic latent image corresponding to the scanning exposure image information is formed. In the present embodiment, the exposure portion potential V1 is set to −150 V. An exposure portion b represents a portion of the photosensitive drum 1 irradiated with the image exposure light L.

(c) Developing Unit

Subsequently, the electrostatic latent image formed on the photosensitive drum 1 is developed with toner by a developing unit 4. According to the present embodiment, the developing unit 4 is a two-component contact developing unit (a two-component magnetic brush developing unit). The developing unit 4 includes a developing container (a developing unit body) 40, a developing sleeve 41 serving as a toner bearing member including a magnet roller fixed to the inner surface of the developing unit 4, and a toner regulation blade 42 serving as a toner regulation member. The developing container 40 contains a two-component developer material (developer material) 46, which is a mixture of resin toner particles (toner) and magnetic carrier particles (carrier). The developing unit 4 further includes toner agitators 43 and 44 disposed on the bottom surface of the developing container 40. The developing sleeve 41 is rotatably disposed in the developing container 40. Part of the outer peripheral surface of the developing sleeve 41 is exposed to outside.

A plurality of the toner regulation blades 42 face the developing sleeve 41 at predetermined intervals. As the developing sleeve 41 rotates in a direction indicated by an arrow, a toner thin film is formed on the developing sleeve 41. In the present embodiment, the developing sleeve 41 is disposed so as to face the photosensitive drum 1 with a minimum distance (SDgap) of 350 μm therebetween. A developing portion c represents a portion where the developing sleeve 41 faces the photosensitive drum 1. In addition, the developing sleeve 41 is rotatingly driven in a direction opposite to the moving direction of the photosensitive drum 1 in the developing portion c. The toner thin film formed on the developing sleeve 41 is brought into contact with the surface of the photosensitive drum 1 in the developing portion c and then is in appropriate sliding contact with the photosensitive drum 1. A predetermined developing bias voltage is applied to the developing sleeve 41 by a power supply (not shown) serving as a voltage applying unit. In the present embodiment, a developing bias voltage applied to the developing sleeve 41 is a vibrating voltage obtained by superimposing the direct current voltage (Vdc) over the alternate current voltage (Vac). More specifically, the developing bias voltage is a vibrating voltage obtained by superimposing the direct current voltage Vdc of −500 V over the alternate current voltage Vac of 1800 Vpp and having a frequency of 1270 Hz.

The toner in the developer material 46 is coated on the rotating developing sleeve 41 to form a thin film, and is conveyed to the developing portion c. The toner is selectively deposited onto the electrostatic latent image formed on the photosensitive drum 1 due to an electric field generated by the developing bias voltage. Thus, the electrostatic latent image is developed into a toner image. In the present embodiment, the toner is deposited onto an exposure bright portion of the photosensitive drum 1. Accordingly, the electrostatic latent image is reverse-developed. As the developing sleeve 41 subsequently rotates, the toner thin film that is formed on the developing sleeve 41 and that has passed through the developing portion c is recovered to a toner reservoir in the developing container 40. In addition, agitating screws 43 and 44 serving as toner agitating members are disposed in the developing unit 4. The agitating screws 43 and 44 rotate in synchronization with the rotation of the developing sleeve 41 so that supplied toner particles are agitated and mixed with carrier particles and are supplied with predetermined electrical charge. Furthermore, the agitating screws 43 and 44 convey the developer material 46 in directions opposite to each other along the lengthwise direction. Thus, the developer material 46 is supplied to the developing sleeve 41. Still furthermore, the agitating screws 43 and 44 convey, to a toner supplying unit, the developer material 46 having a low toner density (the ratio of toner to the developer material) after the development process is performed so that the developer material 46 is circulated in the developing container 40.

A sensor 45 is disposed on an upstream wall surface of the agitating screw 44 of the developing unit 4. The sensor 45 detects the toner density of the developer material 46 by detecting a change in the magnetic permeability of the developer material 46. A toner supply port 47 is formed slightly downstream of the sensor 45 in a direction in which the developer material 46 is circulated. After the development process is performed, the developer material 46 is conveyed to the sensor 45 so that the toner density is detected. In accordance with the detection result, an appropriate amount of toner particles is supplied from a toner supply unit 5 through the toner supply port 47 of the developing unit 4 by the rotation of a screw 51 of the toner supply unit 5 (a developer material supply container). The toner supply unit 5 is connected to the developing unit 4. In this way, the toner density of the developer material 46 is maintained constant. The supplied toner particles are conveyed by the agitating screw 44 and are mixed with carrier particles. Thereafter, an appropriate amount of charge is supplied to the toner and is conveyed to the vicinity of the developing sleeve 41. A thin film of the toner is then formed on the developing sleeve 41 and is used for development. In the present embodiment, negatively charged toner particles having an average diameter of 5.5 μm are employed. In addition, magnetic carrier particles having saturated magnetization of 205 emu/cm^3 and an average diameter of 35 μm are employed. The toner and the carrier particles are mixed in a ratio of 6:94 by weight to produce the developer material 46.

(d) Transfer Unit

An intermediate transfer unit 9 serving as a transfer unit is disposed so as to face the photosensitive drum 1 of each of the image-forming units PY, PM, PC, and PBk. In the intermediate transfer unit 9, the monolithic and seamless intermediate transfer belt 91 serving as an intermediate transfer unit (a second image bearing member) is entrained about a driving roller 94, a tension roller 95, and a secondary transfer counter roller 96 under a predetermined tension. The intermediate transfer belt 91 moves in a direction indicated by an arrow shown in FIG. 3. A toner image formed on the photosensitive drum 1 moves into a primary transfer nip portion (a transfer portion) d formed by the photosensitive drum 1 and the intermediate transfer belt 91. In the primary transfer nip portion d, a primary transfer roller 92 serving as a primary transfer unit is in contact with the back surface of the intermediate transfer belt 91. A primary transfer bias power supply 93 serving as a voltage applying unit is connected to the primary transfer roller 92 in order to independently apply a primary transfer bias voltage to the primary transfer roller 92 in each of the image-forming units PY, PM, PC, and PBk.

In the image-forming unit PY, a first color (yellow) toner image formed on the photosensitive drum 1 through the above-described operation is transferred onto the intermediate transfer belt 91. Subsequently, in the same manner, magenta, cyan, and black toner images formed on the photosensitive drums 1 corresponding to the colors are sequentially transferred on top of the previously transferred image in the image-forming units PM, PC, and PBk. In the present embodiment, to improve the transfer efficiency of the toner transferred to the exposure portion (the exposure portion potential V1=−150 V), a primary transfer bias voltage of +350 V is applied for each of the first to fourth colors. Subsequently, the four color images (a full-color image) formed on the intermediate transfer belt 91 are simultaneously transferred onto the transfer medium P, which is fed from a transfer medium supply unit (not shown) by the secondary transfer roller 10 serving as a secondary transfer unit and is conveyed by the feed roller 13 serving as a conveying unit at a predetermined timing.

Residual toner remaining on the intermediate transfer belt 91 after the secondary transfer is performed is removed by a cleaning blade 11*a* serving as a cleaning unit of an intermediate transfer belt cleaner 11 in order to prepare the next image forming process. It is desirable that the intermediate transfer belt 91 is formed from a rubber belt including a resin or metal core, a resin belt, or a rubber belt. Alternatively, to further improve the quality of an image (e.g., reduction in spatter of toner particles and prevention of center dropout), an intermediate transfer belt having an elastic layer may be employed. According to the present embodiment, a resin belt in which carbon particles are dispersed in polyimide (PI) is employed. The volume resistivity of the resin belt is set to a 10^8 Ωcm level. The thickness of the resin belt is 80 μm, the length of the resin belt in the lengthwise direction is 320 mm, and the circumference of the resin belt is 900 mm. The primary transfer roller 92 is formed from a conductive sponge. The resistance of the primary transfer roller 92 is less than or equal to 10^6Ω. The external diameter of the primary transfer roller 92 is 16 mm. The length of the primary transfer roller 92 in the lengthwise direction is 315 mm.

(e) Fixing Unit

Subsequently, the transfer medium P having the toner image thereon is conveyed to a roller fusing unit 12 serving as the fixing unit. In the roller fusing unit 12, the toner image is fused to the transfer medium P using a combination of heat and pressure. Thereafter, the transfer medium P is output outside the apparatus body. In this way, a color print image can be obtained.

(f) Auxiliary Charging Unit

Excess toner is not transferred onto the transfer medium P in the primary transfer nip portion d, and remains on the photosensitive drum 1. In general, this toner contains toner having a reversed polarity (or reversed toner) and toner having an inappropriate charge amount. Therefore, according to the present embodiment, each of the image-forming units PY, PM, PC, and PBk includes a downstream brush 6 and an upstream brush 7, which together serve as an auxiliary charging unit, so that an appropriate charge amount can be supplied to the residual toner. A bias is applied to the downstream brush 6 and an upstream brush 7 by a downstream brush bias applying unit 21 and an upstream brush bias applying unit 22, respectively. A bias control circuit 130 controls the downstream brush bias applying unit 21 and the upstream brush bias applying unit 22. The downstream brush 6 and the upstream brush 7 are disposed downstream of the primary transfer roller 92 and upstream of the charge roller 2 in the rotational direction of the photosensitive drum 1. The downstream brush 6 and the upstream brush 7 are in contact with the photosensitive drum 1.

In the present embodiment, the upstream brush 7 removes the electrical charge from the photosensitive drum 1. Thereafter, the downstream brush 6 charges the residual toner so as to have normal polarity. Note that when two brushes are provided downstream of a primary transfer unit, one of the brushes closer to the primary transfer unit is referred to as an "upstream brush" and the other brush closer to the charging unit is referred to as a "downstream brush". In this way, deposition of the residual toner on the charge roller 2 can be effectively prevented. In addition, the residual toner can be completely removed and recovered in the developing unit 4. Consequently, the occurrence of a ghosting image caused by a residual toner pattern can be completely prevented.

The upstream brush 7 is a scrub brush having a brush portion 71 on an electrode plate 72. Nylon fibers having a fineness of 2*d*, a density of 230 kF/inch^2, a fiber electrical resistance of 10^7Ω, and a pile length of 5 mm are used for the fibers of the brush portion 71. The brush portion 71 is fixedly disposed so as to be in contact with the surface of the photosensitive drum 1 parallel to the lengthwise direction of the photosensitive drum 1 (a direction substantially perpendicular to the moving direction of the surface). The width of a nip section of the brush portion 71 in contact with the photosensitive drum 1 is 5 mm. In the present embodiment, a bias voltage having a DC component of −500 V and an AC component of ±100 V is applied to the upstream brush 7.

The downstream brush 6 is produced by winding a brush around a ϕ6 mm SUS shaft. The downstream brush 6 is driven by a driving unit (not shown) so as to be able to rotate at any peripheral speed between 0 mm/s and 500 mm/s. The peripheral speed that ensures uniform contact of a fur brush with the photosensitive drum 1 is determined by a mounting method of the fur brush, the shape of the fur brush, and the shape of the photosensitive drum 1. Therefore, the maximum peripheral speed of the downstream brush 6 is limited to a defined value. According to an embodiment, the maximum peripheral speed of the downstream brush 6 is about 500 mm/s. Nylon fibers having a fineness of 2*d*, a density of 430 kF/inch^2, a fiber electrical resistance of 10^7Ω, and a pile length of 2.5 mm are used for the fibers of a brush portion 61. The brush portion 61 is disposed so that the top portion of a length of 1.0 mm is in contact with the surface of the photosensitive drum 1. In an embodiment, a bias voltage having a DC component of −950 V is applied to the downstream brush 6. The fur brush (downstream brush) 6 serves as an auxiliary charging unit and removes residual filler and toner remaining on the surface of the photosensitive drum 1. To this end, the downstream brush 6 rotates at a peripheral speed of about 0% to 75% of the peripheral speed of the photosensitive drum 1 in the same direction, and is in contact with the photosensitive drum 1. This is because as the peripheral speed of the fur brush decreases, the ability of the brush to remove a deposition becomes improved. The reason why this happens is not known. However, an experimental result indicates that as the ratio of the peripheral speed of the fur brush to the peripheral speed of the photosensitive drum increases, an amount of toner deposited on the photosensitive drum (i.e., filming) increases. In the present embodiment, during formation of a normal image (in a non-removal mode), the peripheral speed of the fur brush is controlled by a control unit (not shown) so as to be 60 mm/s.

(2) Toner Removal Mode of Auxiliary Charging Brush

Figure 1:
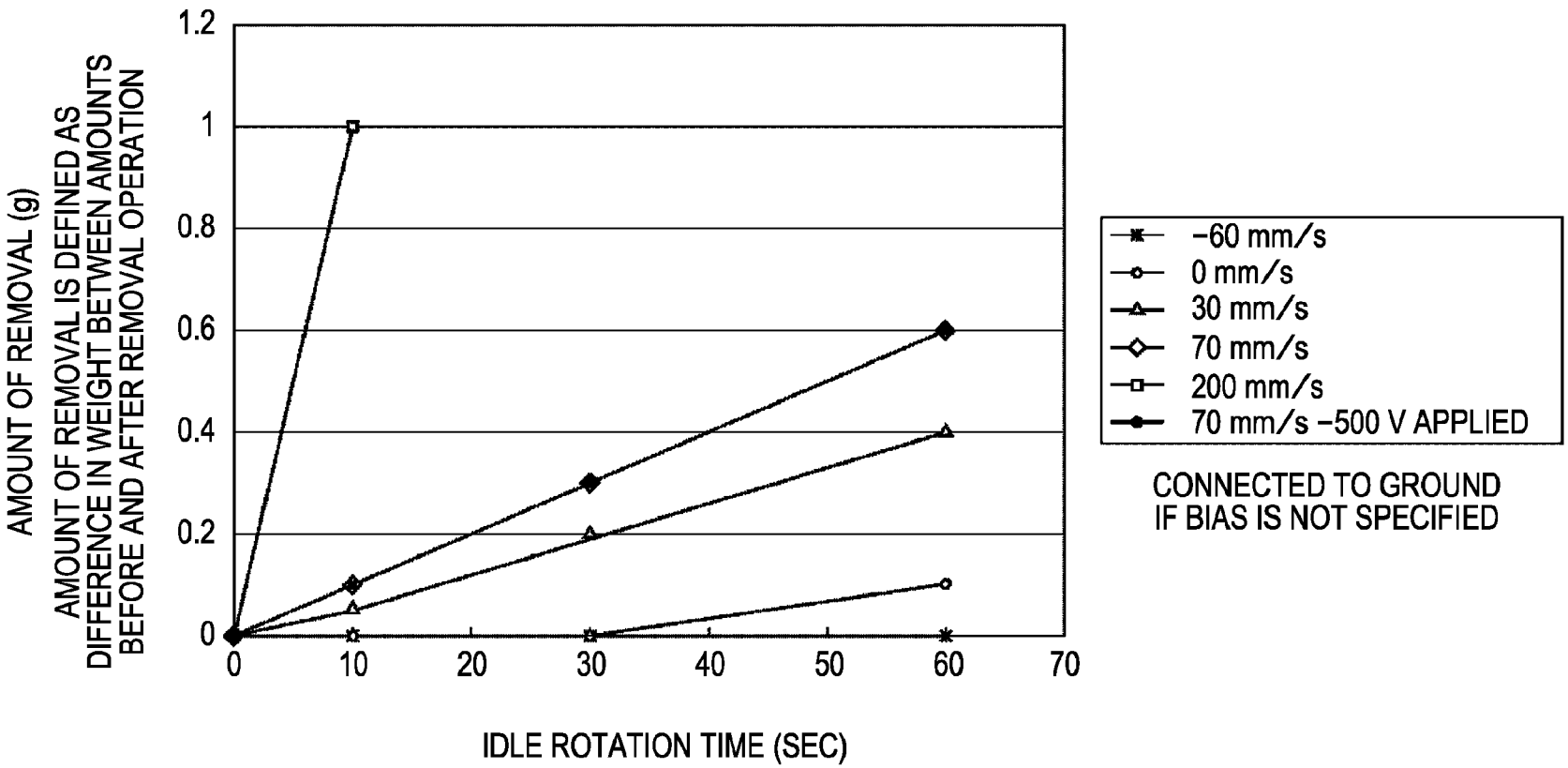
FIG. 1 illustrates a relationship among an amount of removed toner, the peripheral speed of a fur brush, and a period of time of the rotation of the fur brush.

As described above, we found from a review that when the peripheral speed of the fur brush was higher than that of the photosensitive drum, toner particles embedded in the fur brush were removed and deposited on the photosensitive drum. FIG. 1 illustrates the amounts of removed toner in accordance with a rotation time for each of differences between the peripheral speeds of the fur brush and the photosensitive drum. Note that a plus sign indicates that the peripheral speed of the fur brush is higher than that of the photosensitive drum. As can be seen, if the peripheral speed of the fur brush is lower than or equal to that of the photosensitive drum, fewer toner particles are removed from the fur brush. In contrast, as the peripheral speed of the photosensitive drum increases, the amount of removed toner particles increases. In addition, the bias applied to the fur brush has little impact on the amount of pullout toner particles. Therefore, the toner particles are removed by a mechanical effect.

Figure 2A:
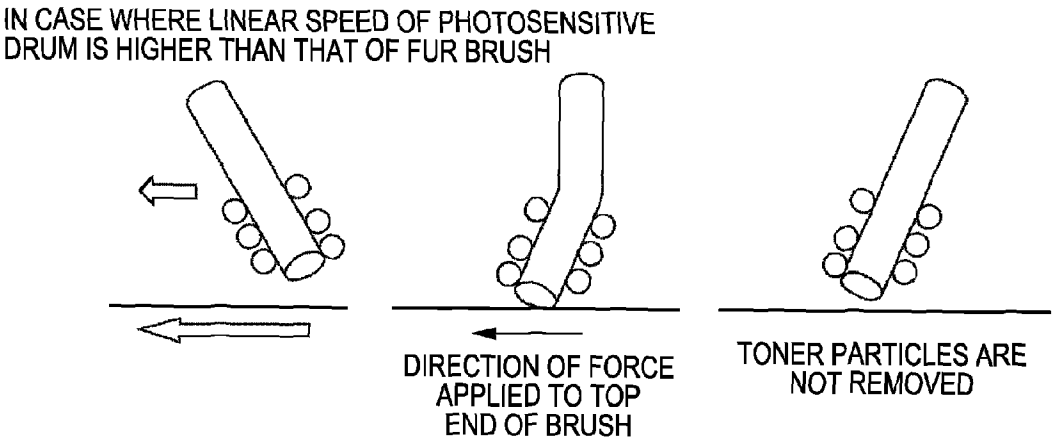
FIGS. 2A and 2B illustrate a proposed mechanism for removing toner particles from a fur brush according to the present invention.
Figure 2B:
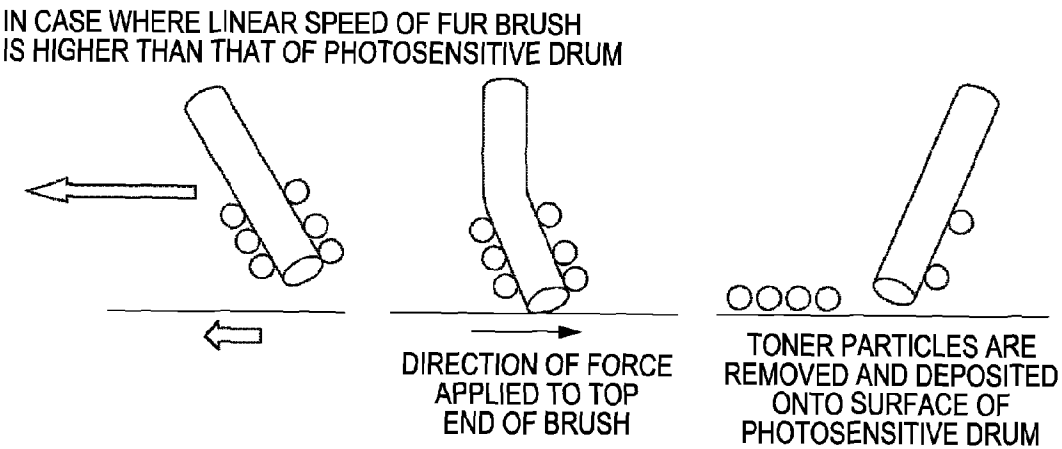

FIGS. 2A and 2B illustrate a removal mechanism proposed. When the peripheral speed of the photosensitive drum is higher than that of the fur brush, the toner particles deposited on the brush and the toner particles sandwiched by brush poles stay unchanged in the rotating fur brush (refer to FIG. 2A). However, when the peripheral speed of the photosensitive drum is lower than that of the fur brush, the top end of the brush is pulled by the surface of the photosensitive drum 1 first. Then, the top end attempts to return to the original position. Thus, the toner particles are removed from the brush (refer to FIG. 2B). On the other hand, if the peripheral speed of the fur brush is higher than that of the photosensitive drum at all times, another problem arises. Electrophotographic cleaner-less image forming apparatuses does not include a member that slides on the surface of the photosensitive drum. Accordingly, filler and toner particles may be deposited onto the photosensitive drum, and therefore, a defective print image may be produced. To remove such deposition, the fur brush is rotated at a peripheral speed of about 0% to about 75% of the peripheral speed of the photosensitive drum in the same direction, and is in contact with the photosensitive drum. As the peripheral speed of the fur brush decreases, the ability of the brush to remove the deposition tends to be improved.

Accordingly, during a warm-up period before image formation and during formation of a normal image, it is desirable that the peripheral speed of the fur brush is set to about 0% to about 75% of the peripheral speed of the photosensitive drum.

Accordingly, a mechanism that changes the peripheral speed of the fur brush in accordance with the environmental conditions is provided. In a normal case, the fur brush is rotated at a peripheral speed of about 0% to about 75% of the peripheral speed of the photosensitive drum. During a warm-up period before image formation, during post-processing after image formation, or after images are formed a predetermined number of times, the peripheral speed of the fur brush is increased in order to remove the toner particles.

As described above, according to the present embodiment, by increasing the peripheral speed of the fur brush in a non-image forming mode to a peripheral speed higher than that in an image forming mode, the removal mode can be provided. In addition, the operation in the removal mode is performed by a control unit or an executing unit (not shown) at any timing during formation of an image. The timing for removing the toner particles from the fur brush, the peripheral speed of the fur brush, and a removal executing time period significantly vary depending on the type of toner and the environmental conditions. Accordingly, a condition needs to be defined under which an amount of removed toner particles for ensuring an amount of electrical current flowing in the downstream brush that does not cause an image defect can be determined.

It is desirable that the timing for executing the sequence of removal of toner particles from the fur brush is a timing other than a timing during formation of an image. Examples of such a timing include a timing at which the apparatus is started up, timings before and after an image is formed, and a timing after images are formed a predetermined number of times, which is determined by the environmental and aging conditions.

In the present embodiment, when the amount of electrical current was decreased to 5 μA in the case of application of −900 V, an image defect occurred. Therefore, under the condition of a temperature of 23° C. and a humidity of 50%, the sequence of removal of toner particles from the fur brush is executed once per 1000 pages for 10 seconds using the peripheral speed of the fur brush higher than that of the photosensitive drum by 200 mm/s.

In addition, it is desirable that the rotational direction of the fur brush is the same as that of the photosensitive drum in the contact portion between the fur brush and the photosensitive drum. If the rotational directions of the fur brush and the photosensitive drum are opposite to each other, toner is removed from the photosensitive drum although an amount of toner particles embedded in the fur brush is decreased. Accordingly, the escape of the toner particles in the apparatus is significant, and therefore, a mechanism for recovering the removed toner particles is needed. Thus, to achieve a cleanerless system, it is desirable that the rotational direction of the fur brush is the same as that of the photosensitive drum.

An example of the sequence of removal of toner particles from the fur brush according to the present embodiment is described next.

Upon receipt of an instruction to start the sequence of removal of toner particles, if the photosensitive drum does not rotate, the drive of the photosensitive drum and the fur brush is turned on. At that time, the peripheral speed of the fur brush is set to be lower than that of the photosensitive drum. In the present embodiment, in a normal case (in a non-removal mode), the peripheral speed of the fur brush is set to 60 mm/s.

Subsequently, in order to remove toner particles, the peripheral speed of the fur brush is set to 330 mm/s. During the removal of toner particles, the bias applied to the fur brush is set to the ground level. However, the present invention is not limited thereto. Thus, the toner particles are removed from the fur brush onto the photosensitive drum. Before the removed toner particles arrive at the position of the charge roller, a bias applied to the charge roller is set to Vdc of −1000 V. In this way, the toner particles removed onto the photosensitive drum are negatively charged by applying an electrical current including only a DC component using the charge roller. After the toner particles are transferred onto the intermediate transfer member by the developing unit or the primary transfer unit, the toner particles are recovered by an intermediate transfer member cleaning member.

As described above, according to the present embodiment, the absolute value of the bias applied to the charge roller in a removal mode is larger than that during formation of an image. This is because since most of the toner particles removed from the fur brush are toner particles having a charge of a reverse polarity and toner particles having no charge, these toner particles removed from the fur brush may not be removed from the photosensitive drum 1 during the development and transfer time. Accordingly, the toner particles are re-charged so as to have charge of a normal polarity when the toner particles pass through the charge roller.

According to the present embodiment, the toner particles are not recovered in the development process. The toner particles are recovered by the cleaning member of the intermediate transfer member. Accordingly, no bias is applied to the developing sleeve. The developing sleeve only rotates. The primary transfer unit transfers the toner particles that have passed through the charge roller and were negatively charged onto the intermediate transfer member. The bias applied to the transfer roller is the same as that applied during formation of an image. In this way, the toner particles removed from the fur brush are finally recovered by the cleaning member of the intermediate transfer member.

Figure 5:
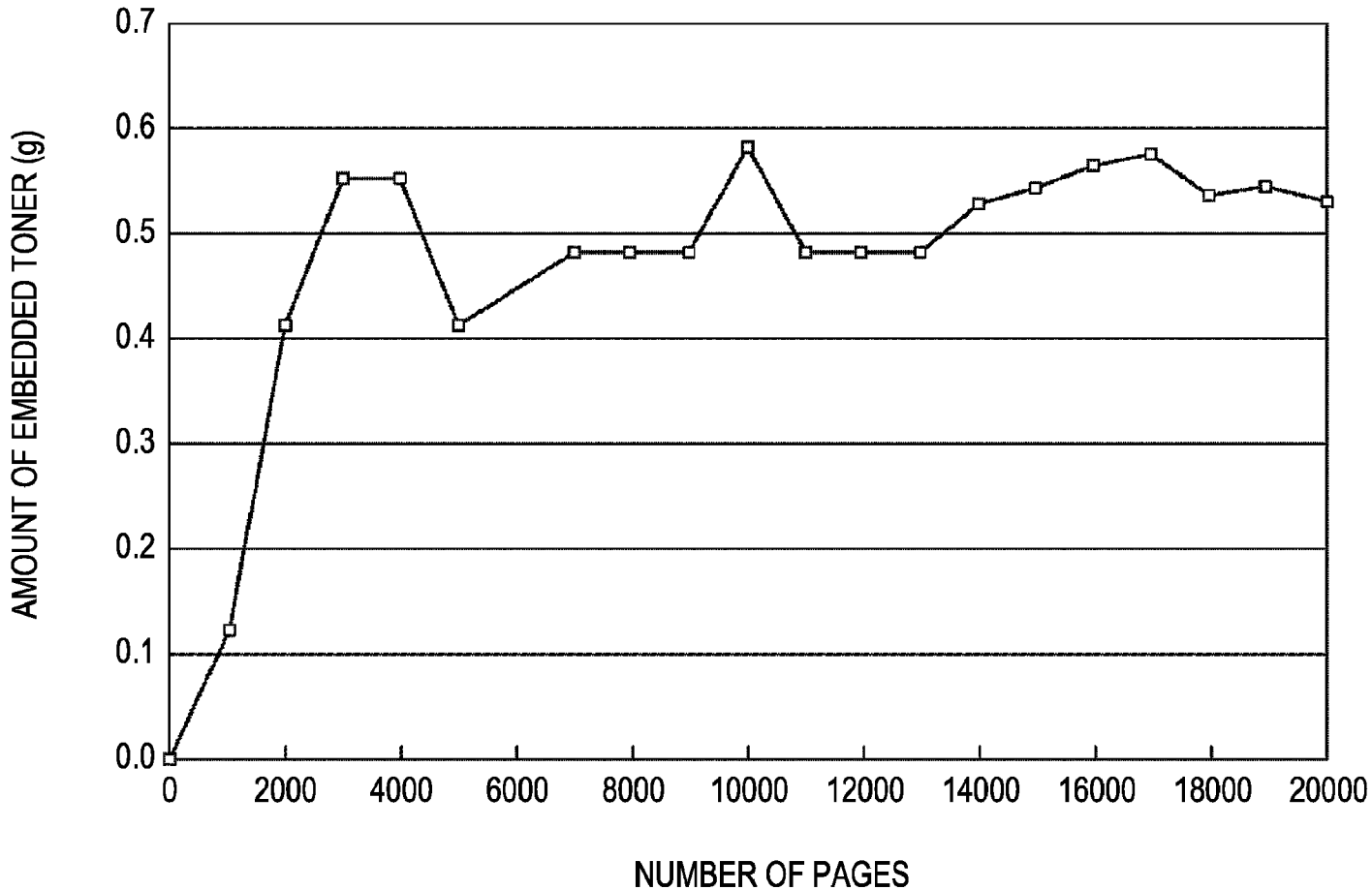
FIG. 5 illustrates the transition of an amount of toner embedded in a fur brush according to the embodiment.

FIG. 5 illustrates an amount of toner embedded in the fur brush when a 30% duty image was formed on up to 20000 pages and the toner removal according to the present embodiment was performed. As can be seen from FIG. 5, the amount of toner embedded in the fur brush is constant after the image is formed on 4000 pages. From that point of time, substantially the same amount of toner is embedded in the fur brush.

Figure 6:
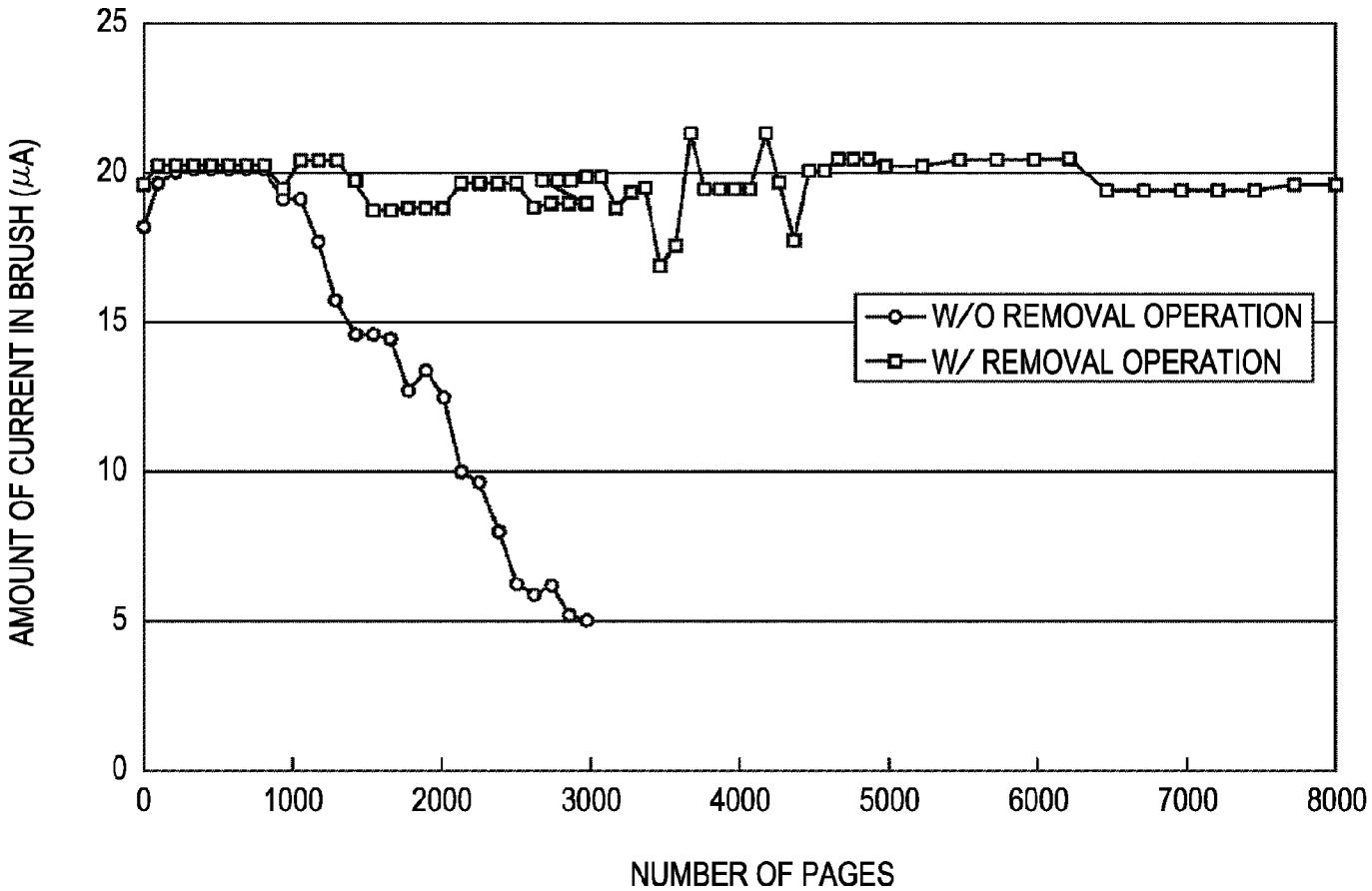
FIG. 6 illustrates the transition of an amount of electrical current flowing in the brush in the cases where toner particles are removed and toner particles are not removed from the brush.

FIG. 6 illustrates the transition of the amount of the electrical current flowing in the brush when a 30% duty image was formed on up to 8000 pages in the case where the toner removal according to the present embodiment was performed and no toner removal was performed. Except for whether or not the toner removal operation is performed, the images were formed under the same condition. As can be seen from FIG. 6, in the case where the toner removal operation is performed, the electrical current is reduced by a significantly small amount. However, in the case where no toner removal operation is performed, the electrical current is reduced by an amount that causes a defective print image when images are formed on about 3000 sheets. Subsequently, the toner removal operation was performed and images were formed on up to 20000 pages. At that time, the electrical current was not reduced.

Other Embodiments

While the embodiments above have been described with reference to the structure in which a scrub brush is used for the upstream brush, the present invention is not limited thereto. Any structure that can remove a residual potential on the photosensitive drum may be employed. For example, a fur brush can be used for the upstream brush. In addition, an exposure apparatus, such as a light-emitting diode (LED) array, can be employed without any problem.

While the present invention has been described with reference to the structure in which toner is transferred on a recording material using an intermediate transfer belt, the present invention is not limited thereto. Any method that can directly transfer toner from an image bearing member to a recording material may be employed. In addition, while the present invention has been described with reference to the structure including a plurality of image bearing members, a structure in which developing units for the used colors are provided to a single image bearing member and an image is formed can be employed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-310379 filed Nov. 16, 2006, which is hereby incorporated by reference herein in its entirety.

What is claimed is:

1. An image forming apparatus comprising:

a rotatable photosensitive member;

a charging device configured to charge said photosensitive member;

an electrostatic image forming device configured to form an electrostatic image on the photosensitive member charged by the charging device;

a developing device configured to collect toner attached to the photosensitive member and develop the electrostatic image with toner;

a transfer device configured to transfer a toner image formed on the photosensitive member onto an image-receiving member;

a rotatable brush being in contact with the photosensitive member at a position downstream of the transfer device and upstream of the charging device in a rotational direction of the photosensitive member, the rotatable brush configured to supply electrical charge to the residual toner that is not transferred by the transfer device; and a control unit configured to control the rotatable brush so that the rotatable brush rotates at a first peripheral speed slower than a peripheral speed of the photosensitive member while an image is formed and so that the rotatable brush rotates at a second speed faster than the peripheral speed of the photosensitive member while an image is not formed.

2. The image forming apparatus according to claim 1, wherein the control unit controls the rotatable brush so that the rotatable brush rotates in a same direction as a rotation direction of the photosensitive member at a peripheral speed smaller than or equal to 0.75 times a peripheral speed of the photosensitive member while an image is formed.

3. The image forming apparatus according to claim 1, wherein the control unit controls applying a first bias on the brush so that toner on the photosensitive member is collected by the development unit while an image is formed and controls applying a second bias different from the first bias on the brush so that toner attached to the brush is discharged to the photosensitive member while an image if not formed.

4. The image forming apparatus according to claim 3, wherein the control unit controls applying a charging bias while an image is not formed, the charging bias different from a charging bias to be applied while an image is formed, in order to adjust charges of the toner discharged from the brush to the photosensitive member.

* * * * *